US008333624B2

(12) United States Patent
Kakuta

(10) Patent No.: US 8,333,624 B2
(45) Date of Patent: Dec. 18, 2012

(54) TERMINAL FITTING

(75) Inventor: Naoki Kakuta, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/061,720

(22) PCT Filed: Sep. 3, 2009

(86) PCT No.: PCT/JP2009/065434
§ 371 (c)(1),
(2), (4) Date: Mar. 2, 2011

(87) PCT Pub. No.: WO2010/027027
PCT Pub. Date: Mar. 11, 2010

(65) Prior Publication Data

US 2011/0165800 A1 Jul. 7, 2011

(30) Foreign Application Priority Data

Sep. 3, 2008 (JP) ..... 2008-225596

(51) Int. Cl.
*H01R 4/18* (2006.01)

(52) U.S. Cl. ..... 439/877

(58) Field of Classification Search ..... 439/882, 439/877
See application file for complete search history.

(56) References Cited

U.S. PATENT DOCUMENTS

| | | | | |
|---|---|---|---|---|
| 5,425,662 | A | 6/1995 | Villeneuve | |
| 5,975,965 | A * | 11/1999 | Jordan | 439/877 |
| 6,056,605 | A * | 5/2000 | Nguyen et al. | 439/882 |
| 6,749,457 | B2 * | 6/2004 | Sakaguchi et al. | 439/421 |
| 2005/0026515 | A1 | 2/2005 | Hashimoto et al. | |
| 2007/0264873 | A1 | 11/2007 | Kakuta | |

FOREIGN PATENT DOCUMENTS

| | | | |
|---|---|---|---|
| EP | 0070639 | A1 | 1/1983 |
| EP | 0619623 | A1 | 10/1994 |
| JP | 56-056169 | U | 5/1981 |
| JP | 60-035471 | U | 3/1985 |
| JP | 60-193671 | U | 12/1985 |
| JP | 64-009361 | U | 1/1989 |

(Continued)

OTHER PUBLICATIONS

International Search Report [PCT/ISA/210] issued in PCT/JP2009/065434, dated Oct. 6, 2009.

(Continued)

*Primary Examiner* — Gary F. Paumen
(74) *Attorney, Agent, or Firm* — Sughrue Mion, PLLC

(57) ABSTRACT

Provided is a terminal fitting capable of reliably press-bonding a core wire made of aluminum or aluminum alloy. A terminal fitting 3 is made of copper or copper alloy and includes: a bottom wall 34 which is overlapped with a core wire 41 made of aluminum or aluminum alloy; and a pair of crimping pieces 35 which is upright from each corresponding end portion of the bottom wall 34 and is bent inward so that a front end 35*a* faces the bottom wall 34 and the pair of crimping pieces is press-bonded to the core wire 41. The pair of crimping pieces 35 is bent so that outer surfaces 35*b* are tightly overlapped with each other, and has a pair of intermeshing portions 38 respectively formed in the outer surfaces 35*b* in the length direction of the core wire 41 to mesh with each other.

7 Claims, 5 Drawing Sheets

FOREIGN PATENT DOCUMENTS

| | | | |
|---|---|---|---|
| JP | 03-121661 | U | 12/1991 |
| JP | 05-084032 | U | 11/1993 |
| JP | 07-006800 | A | 1/1995 |
| JP | 2000021464 | A | 1/2000 |
| JP | 2003-272728 | A | 9/2003 |
| JP | 2005-116236 | A | 4/2005 |
| JP | 2005-174896 | A | 6/2005 |
| JP | 2007-257905 | A | 10/2007 |

OTHER PUBLICATIONS

Extended European Search Report dated Sep. 10, 2012 issued by the European Patent Office in corresponding European Patent Application No. 09811552.0.

* cited by examiner

TERMINAL FITTING

TECHNICAL FIELD

The present invention relates to a terminal fitting that is used in a connector and the like, and particularly, to a terminal fitting that is press-bonded to a core wire made of aluminum or aluminum alloy.

BACKGROUND ART

Various electronic devices are mounted on a vehicle as transportation. The vehicle is equipped with a wire harness that is used to transmit power from a power supply or control signals from a control device to the electronic devices.

The wire harness includes a wire and a connector. The wire includes a core wire which is obtained by twisting thin wires, and an insulation coating which is formed of an insulating synthetic resin and covers the outer periphery of the core wire. The connector includes a housing which is formed of an insulating synthetic resin, and a terminal fitting which is received inside the housing and is attached to the terminal end of the wire.

In general, copper is used as a material of the core wire used in the wire harness. However, in recent years, there has been a strong demand for a reduction in the weight or an improvement in recyclability of the vehicle in accordance with increasing ecological awareness. For this reason, aluminum or aluminum alloy having a specific weight that is ⅓ of copper and has excellent recyclability has been more widely used as the core wire of the harness. Further, Patent Document 1 discloses a terminal fitting that is attached to a wire harness having a core wire made of aluminum or aluminum alloy.

The terminal fitting proposed by Patent Document 1 is shown in FIG. 8. A terminal fitting 701 includes a terminal contact portion 710 and a wire connection portion 720. The terminal contact portion 710 is formed in a rectangular cylindrical shape, and has a spring piece therein. Further, the wire connection portion 720 includes a wire barrel 721 which press-bonds a core wire 741 of a wire 740, and an insulation barrel 722 which press-bonds the wire 740 from above an insulation coating 742.

The wire barrel 721 is formed to have a fork structure of which the heights of the front and rear portions are different from each other. That is, the wire barrel 721 includes a first wire barrel 721*a* which is adjacent to the insulation barrel 722, and a second wire barrel 721*b* which is lower than the first wire barrel 721*a*.

The wire 740 press-bonded by the wire barrel 721 includes a core wire 741 which is obtained by twisting thin wires made of aluminum or aluminum alloy, and an insulation coating 742 which is formed of an insulating synthetic resin and covers the outer periphery of the core wire 741, where the core wire 741 is exposed by removing the insulation coating 742 by a predetermined length from the end portion of the wire 740. The exposed core wire 741 includes a first conductor portion which is adjacent to the insulation coating 742 and has a predetermined length and a large diameter, and a second conductor portion which is adjacent to the first conductor portion, is obtained by removing thin wires located at the outer peripheral surface of the first conductor portion, and has a predetermined length and a small diameter.

Then, the first wire barrel 721*a* of the terminal fitting 701 is crimped to be press-bonded to the first conductor portion of the wire, and the second wire barrel 721*b* of the terminal fitting 701 is crimped to be press-bonded to the second conductor portion of the wire, thereby connecting the terminal fitting 701 to the core wire 741 of the wire 740. Further, the insulation barrel 722 of the terminal fitting 701 is crimped to be press-bonded to the insulation coating 742 of the wire 740, so that the terminal fitting 701 is fixed to the insulation coating 742 of the wire 740. Then, according to the terminal fitting 701, as shown in FIGS. 9 and 10, the respective thin wires of the wire 740 may be made to contact the terminal fitting 701 and maintain a reliable electric connection.

PRIOR ART LITERATURE

Citation List

Patent Literature 1: JP-A-2005-116236

SUMMARY OF INVENTION

Technical Problem

Since the above-described terminal fitting 701 has a spring piece inside the terminal contact portion 710, it is desirable that the terminal fitting is made of copper or copper alloy having an excellent spring property and a conduction property. However, since copper or copper alloy has a larger springback characteristic than that of aluminum or aluminum alloy, when the terminal fitting 701 made of copper and copper alloy is crimped to be press-bonded to the core wire 741 made of aluminum or aluminum alloy, the press-bonding state becomes loosened due to a difference in the springback characteristic. Accordingly, since a value of a contact resistance at the press-bonding position becomes larger, there is a problem in that a contact error occurs. As a method of avoiding such a problem, a method may be supposed which strongly crimps and press-bonds the wire barrels 721*a* and 721*b* of the terminal fitting 701 (for example, a compression ratio of a conductor (core wire) is set to be 70% or less). However, in this case, since the core wire 741 is pressed, the core wire 741 may be easily broken when a load of pulling the core wire 741 in the length direction is generated. Accordingly, there is another problem in that the strength of fixing the core wire 741 is degraded. Further, as another method of avoiding such a problem, a method may be supposed which strongly crimps the second wire barrel 721*b* (for example, the compression ratio of the conductor (core wire) is set to be 70% or less) so that the contact resistance is suppressed to be low, and loosely crimps the first wire barrel 721*a* compared to the second wire barrel 721*b* so that the fixation strength to the core wire 741 is ensured. However, the electric performance (that is, the low stable resistance) of the wire barrel 721 is dependent on the second wire barrel 721*b*. Accordingly, there is another problem that the total electric performance of the wire barrel 721 (that is, the wire barrels 721*a* and 721*b*) is worse than that of the case of using the general wire that does not have the first and second conductor portions.

The invention is made to solve the above-described problems. That is, an object of the invention is to provide a terminal fitting capable of reliably press-bonding a core wire made of aluminum or aluminum alloy.

Solution to Problem

In order to attain the above-described object, according to a first aspect of the invention, there is provided a terminal fitting that crimps a wire made of aluminum or aluminum alloy, the terminal fitting including: a bottom wall on which the wire is disposed and which has two end portions facing each other; and a pair of crimping pieces each of which has an outer surface with an intermeshing portion and which is formed upright from the corresponding end portion, the crimping pieces being bent to crimp the wire so that one intermeshing portion meshes with the other intermeshing portion. Particularly, each intermeshing portion may have a plurality of grooves. Further, the intermeshing portions may preferably be brought into tight contact with each other when the wire is crimped.

According to a second aspect of the invention, in the first aspect of the invention, the plurality of grooves of the pair of intermeshing portions are formed in a wedge shape cut into the thickness direction of the pair of crimping pieces, and the width of a pair of wall portions forming the grooves is equal to the opening width of the groove.

According to a third aspect of the invention, in the second aspect of the invention, the opening width of the grooves is formed to be equal to 1/20 and equal to or less than 1/10 of the thickness of the pair of crimping pieces.

Advantageous Effects of Invention

According to the first aspect of the invention, the pair of crimping pieces is bent so that the outer surfaces are tightly overlapped with each other, and has the pair of intermeshing portions respectively formed at the outer surfaces in the length direction of the core wire, where the pair of intermeshing portions has a plurality of grooves and is adapted to mesh with each other. The deformation caused by the bending of the pair of crimping pieces cancels the restoring force, and the pair of intermeshing portions meshes with each other, whereby the pair of crimping pieces is fixed to each other, and the tightly fitted state of the core wire using the pair of crimping pieces may be maintained. For this reason, the core wire may be reliably press-bonded by preventing a springback. Further, since an excessive press-bonding operation (for example, a compression ratio of a conductor (core wire) becomes 70% or less) may not be performed by preventing the springback, the fixation strength of the core wire may be ensured.

According to the second aspect of the invention, the plurality of grooves provided in the pair of intermeshing portions are formed in a wedge shape which is cut into the thickness direction of the pair of crimping pieces, and the width of the pair of wall portions forming the grooves is equal to the opening width of the groove, that is, the cross-sectional shape of the grooves of the pair of intermeshing portions is formed as an equilateral triangle. Accordingly, the intermeshing portion may be made to easily mesh with each other so that they are reliably fixed to each other. Further, since the shape of the grooves is simple, the grooves may be easily provided.

According to the third aspect of the invention, since the opening width of the grooves of the pair of intermeshing portions is formed to be equal to or more than 1/20 and equal to or less than 1/10 of the thickness of the pair of crimping pieces, the pair of crimping pieces may be fixed to each other without degrading the strength of the pair of crimping pieces.

DESCRIPTION OF EMBODIMENTS

Figure 1:
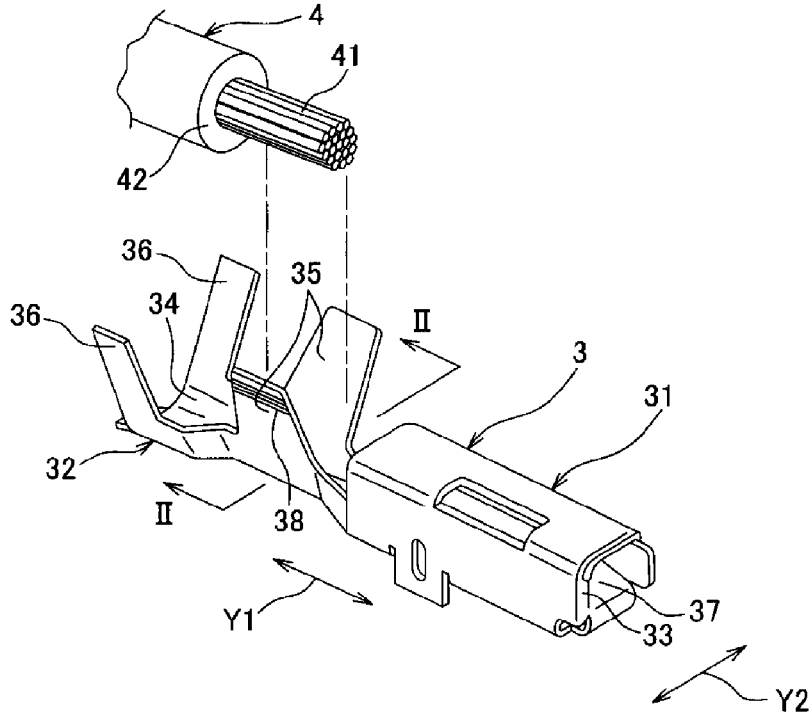
FIG. 1 is a perspective view illustrating a terminal fitting and a wire mounted on the terminal fitting according to an embodiment of the invention.

Hereinafter, an embodiment of a terminal fitting according to the invention will be described by referring to FIGS. 1 to 7. The terminal fitting (which is denoted by reference numeral 3 in the drawing) is attached to a terminal end of a cable (which is denoted by reference numeral 4 in the drawing) having a core wire made of aluminum or aluminum alloy, and is electrically and physically connected to the core wire.

Figure 2:
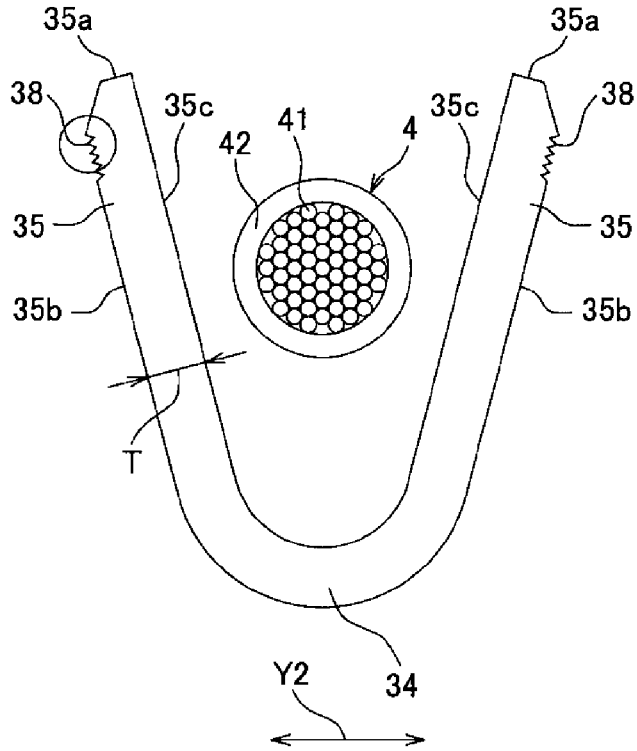
FIG. 2 is a cross-sectional view taken along the line II-II of FIG. 1.
Figure 3:
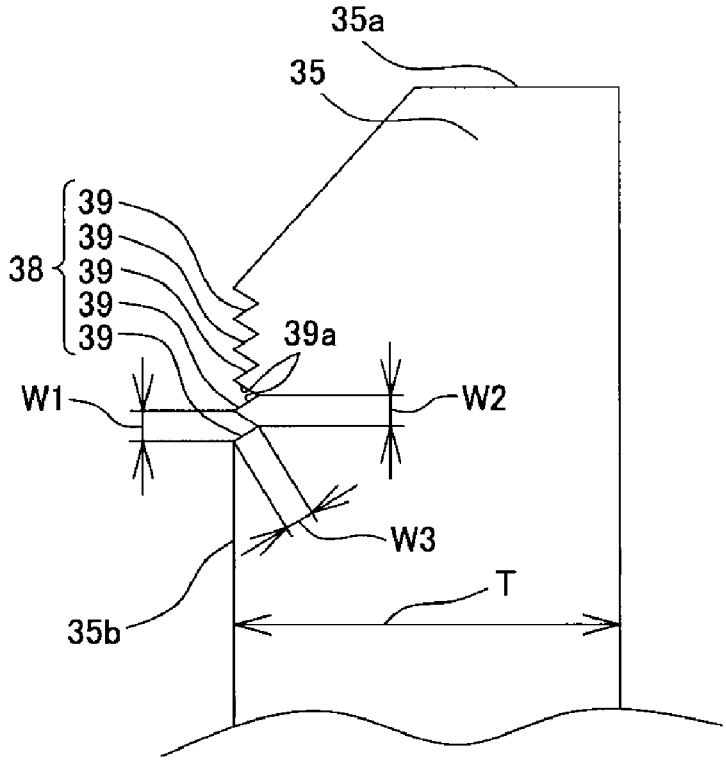
FIG. 3 is an enlarged diagram illustrating a circular portion of FIG. 2.

As shown in FIG. 1, the cable 4 connected to the terminal fitting 3 includes an aluminum core wire 41 which is obtained by twisting a plurality of thin wires made of aluminum or aluminum alloy, and a coating portion 42 which is an insulation coating formed of, for example, an insulating synthetic resin such as polyvinyl chloride (PVC) or polypropylene (PP) and coating the aluminum core wire 41. As shown in FIG. 2, the aluminum core wire 41 has a circular cross-section. At the terminal end of the cable 4, an aluminum core wire 41 obtained by removing the coating portion 42 is exposed.

The terminal fitting 3 is obtained in a manner such that a metal sheet made of copper or copper alloy is perforated in a predetermined shape and is bent. As shown in FIG. 1, the terminal fitting integrally includes an electric contact portion 31 which is connected to a counter terminal fitting (not shown) and a wire connection portion 32 which is connected to the aluminum core 41 of the cable 4.

The electric contact portion 31 includes a rectangular cylindrical portion 33 and a spring piece 37 which is received inside the cylindrical portion 33. In the example shown in the drawing, the cylindrical portion 33 is formed in a rectangular cylindrical shape. The spring piece 37 is adapted to bias an insertion element such as a male tab of a counter terminal fitting intruding into the cylindrical portion 33 toward the inner surface of the cylindrical portion 33 so that the insertion element is interposed therebetween. That is, the electric contact portion 31 is electrically and physically connected to the counter terminal fitting in a manner such that the insertion element such as the male tab of the counter terminal fitting is inserted into the cylindrical portion 33, and the insertion element is interposed between the spring piece and the inner surface of the cylindrical portion 33.

As shown in FIGS. 1 and 2, the wire connection portion 32 includes a bottom wall 34 which has an arc-shaped cross-section, a pair of core wire crimping pieces 35, and a pair of coating portion crimping pieces 36. The bottom wall 34 is continuous to the outer wall of the cylindrical portion 33 so that the length direction Y1 follows the length direction of the cylindrical portion 33. On the bottom wall 34, the cable 4 is disposed to be overlapped with the surface located at the upper side of the drawing. The bottom wall 34 corresponds to the bottom wall described in the claims.

The pair of crimping pieces 35 is disposed at the vicinity of the center of the length direction Y1 of the bottom wall 34, and both ends face each other in the width direction Y2 to be upright to above the drawing.

As shown in FIG. 2, in the pair of crimping pieces 35, each of a pair of intermeshing portions 38 is provided in the vicinity of a front end 35*a* and is disposed at an outer surface 35*b* on the opposite side of each of inner surfaces 35*c* facing each other so that the intermeshing portions face each other and mesh with each other. The pair of intermeshing portions 38 is provided with a plurality of grooves 39 which are formed along the length direction Y1 (that is, the length direction of the aluminum core wire 41 overlapping with the bottom wall 34) of the bottom wall 34.

Each of the plurality of grooves 39 is formed to have a cross-section formed in a wedge shape (V-shape) which is cut into the thickness direction of the core wire crimping piece 35. Then, an opening width W1 of the grooves 39 is formed to be equal to a width W3 of a pair of wall portions 39*a* forming the grooves 39. Further, a gap W2 of adjacent deepest portions of the grooves 39 is formed to be equal to the opening width W1 of the grooves 39. That is, since the cross-section of the grooves 39 is formed as an equilateral triangle, the intermeshing portions may be made to easily mesh with each other, and to be reliably fixed to each other after the meshing. Further, since the shape of the grooves 39 is simple, the grooves may be easily formed. Furthermore, regarding the plurality of grooves 39, the shape thereof may be formed arbitrarily as long as the pair of intermeshing portions 38 may mesh with each other to be fixed to each other.

Further, when the opening width W1 (that is, the width W3 of the pair of wall portions 39*a*) of each of the plurality of grooves 39 is formed to be equal to or more than 1/20 and equal to or less than 1/10 of the thickness T of the core wire crimping piece 35, the intermeshing portions may be fixed to each other without degrading the strength of the pair of crimping pieces 35. Particularly, it is desirable that the opening width W1 of the grooves 39 is 1/20 of the thickness T of the core wire crimping piece 35.

Figure 4:
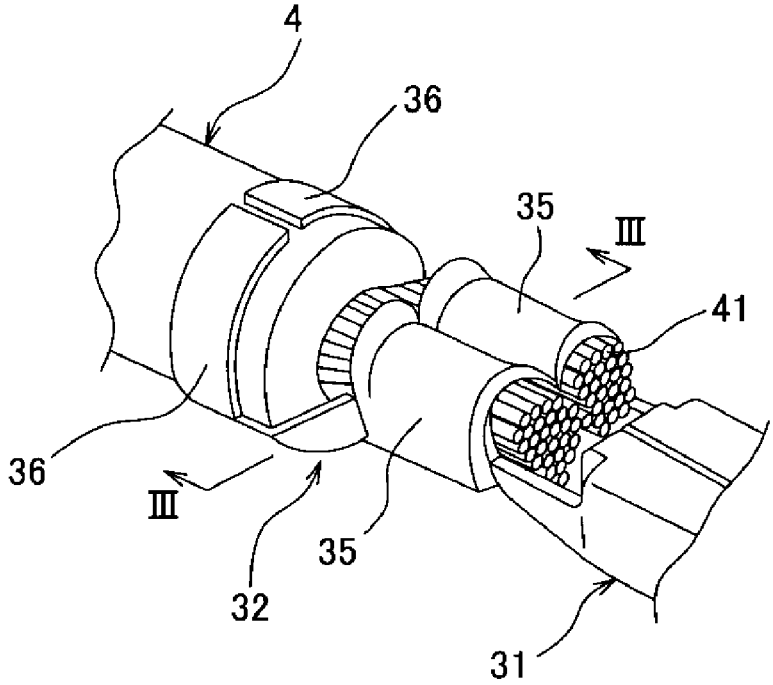
FIG. 4 is a perspective view illustrating a state in which the terminal fitting and the wire of FIG. 1 are crimped.
Figure 5:
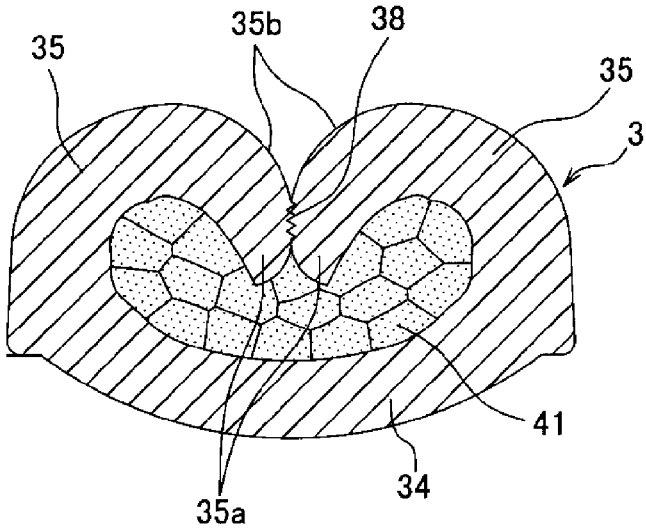
FIG. 5 is a cross-sectional view taken along the line III-III of FIG. 4.

As shown in FIG. 4 and the like, the pair of core wire crimping pieces 35 is bent in the direction in which each front end 35*a* moves closer to the bottom wall 34, and is crimped to be press-bonded to each other so that the front ends 35*a* shrink to the aluminum core wire 41 of the cable 4 overlapped with the bottom wall 34. At this time, the pair of core wire crimping pieces 35 and the bottom wall 34 are brought into press-contact with the aluminum core wire 41 with the aluminum core wire 41 interposed therebetween. Further, as shown in FIG. 5, in the pair of core wire crimping pieces 35, the outer surfaces 35*b* are tightly overlapped with each other, and the pair of intermeshing portions 38 mesh with each other to fix the pair of core wire crimping pieces 35 to each other, thereby maintaining the tightly fitted state of the aluminum core wire 41 using the pair of crimping pieces.

The pair of coating portion crimping pieces 36 is provided at the end portion of the bottom wall 34 away from the electric contact portion 31. The pair of coating portion crimping pieces 36 faces each other from both facing ends in the width direction Y2 of the bottom wall 34 to be upright to above the drawing. As shown in FIG. 4 and the like, the pair of coating portion crimping pieces 36 is bent so that the edge (that is, the front end) away from the bottom wall 34 moves closer to the bottom wall 34 and the inner surface is tightly overlapped with the outer peripheral surface of the coating portion 42 of the cable 4. Accordingly, the coating portion 42 of the cable 4 is interposed between the bottom wall 34 and the pair of coating portion crimping pieces. In this manner, the coating portion crimping pieces 36 are crimped to be press-bonded to the coating portion 42 of the cable 4.

Figure 6:
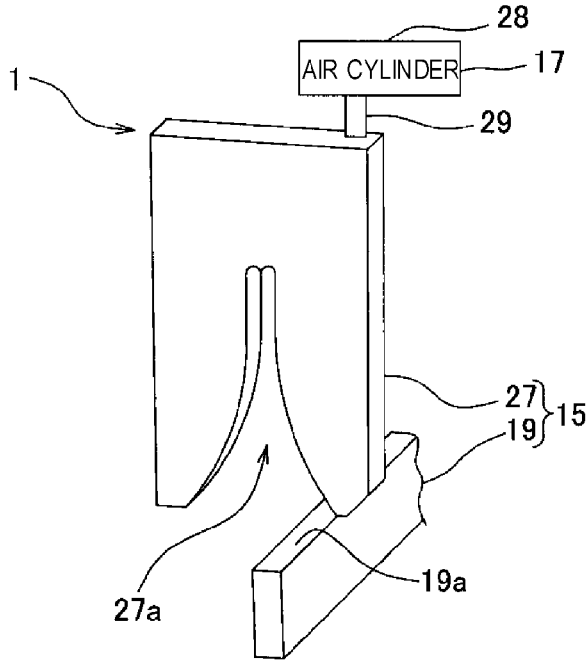
FIG. 6 is a diagram illustrating an example of a press-bonding device that press-bonds a cable and the terminal fitting shown in FIG. 1.

The terminal fitting 3 having the above-described configuration is attached to the terminal end of the cable 4 by using, for example, a press-bonding device 1 shown in FIG. 6. That is, by using the press-bonding device 1, the front ends 35*a* of the pair of core wire crimping pieces 35 of the terminal fitting 3 are bent inward in the direction moving closer to the bottom wall 34, and the front ends of the coating portion crimping pieces 36 of the terminal fitting 3 are bent inward in the direction moving closer to the bottom wall 34. Accordingly, the terminal fitting 3 is press-bonded to the terminal end of the cable 4 in a manner such that the pair of core wire crimping pieces 35 and the pair of coating portion crimping pieces 36 are crimped to the aluminum core wire 41 and the coating portion 42 of the cable 4.

As shown in FIG. 6, the press-bonding device 1 includes a device body (not shown), a crimping portion 15 which serves as a crimping means, and an air cylinder 17 which serves as a driving source. The device body is provided on a floor or the like of a factory. Furthermore, as the driving source, a motor or a hydraulic driving source may be used.

The crimping portion 15 includes an anvil 19 which serves as a mold and a crimper 27 which serves as a mold. The anvil 19 is fixed to the device body. In the anvil 19, the terminal fitting 3 is disposed and overlapped on a surface 19*a*.

The crimper 27 is supported to the device body so as to face the anvil 19 with a gap therebetween and is movable close to or away from the anvil 19. That is, the anvil 19 and the crimper 27 are provided so as to be able to move close to or away from each other. Furthermore, the close or away movement indicates that the members move close to or away from each other. The crimper 27 is provided with a groove 27*a* which is formed from the edge portion closest to the anvil 19 in the close or away movement direction. The groove 27*a* is formed such that the width becomes narrower as it moves away from the anvil 19.

While the anvil 19 and the crimper 27 are away from each other, the terminal fitting 3 and the cable 4 are positioned on the surface 19*a* of the anvil 19. Subsequently, the anvil 19 and the crimper 27 move close to each other, the terminal fitting 3 and the cable 4 are interposed therebetween, and each of the pair of core wire crimping pieces 35 and the pair of coating portion crimping pieces 36 is crimped to the cable 4.

The air cylinder 17 serving as the driving source includes a cylinder body 28 and a rod 29 which is able to move out from or move into the cylinder body 28. The cylinder body 28 is attached to the device body. The rod 29 is attached to the crimper 27. The air cylinder 17 moves the crimper 27 close to the anvil 19 by moving the rod 29 out from the cylinder body 28, and moves the crimper 27 away from the anvil 19 by moving the rod 29 into the cylinder body 28.

Figure 7:
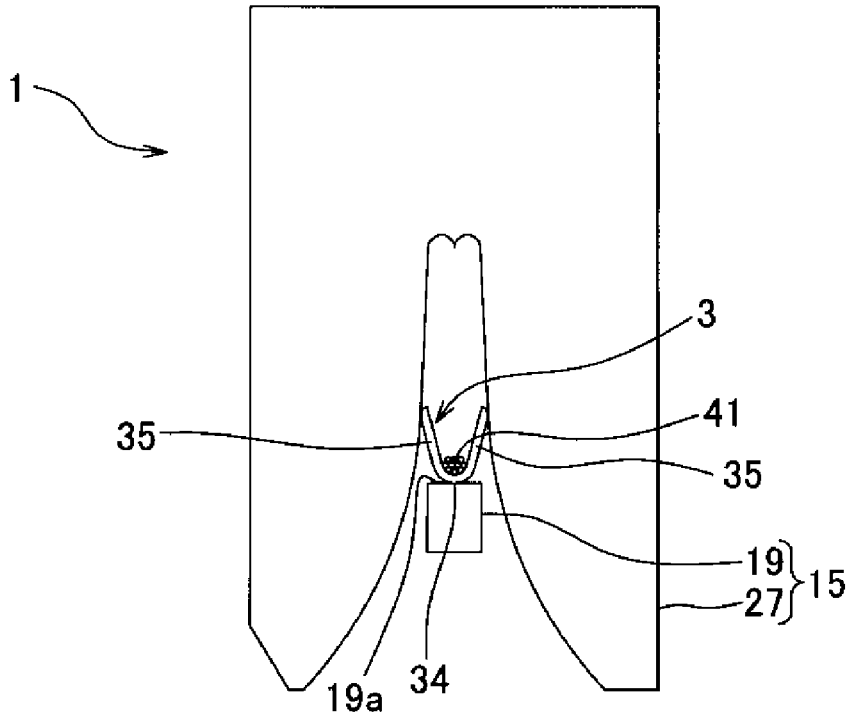
FIG. 7 is a diagram illustrating a state in which an anvil and a crimper of the press-bonding device shown in FIG. 6 are close to each other.
Figure 8:
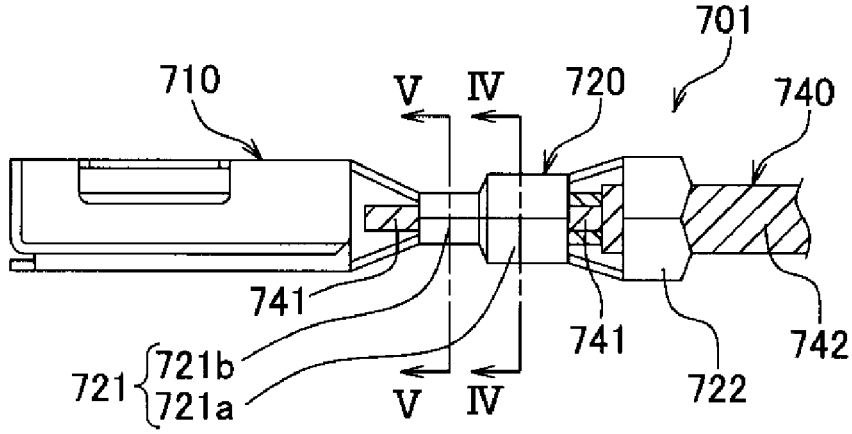
FIG. 8 is a front view illustrating an example of an existing terminal fitting.
Figure 9:
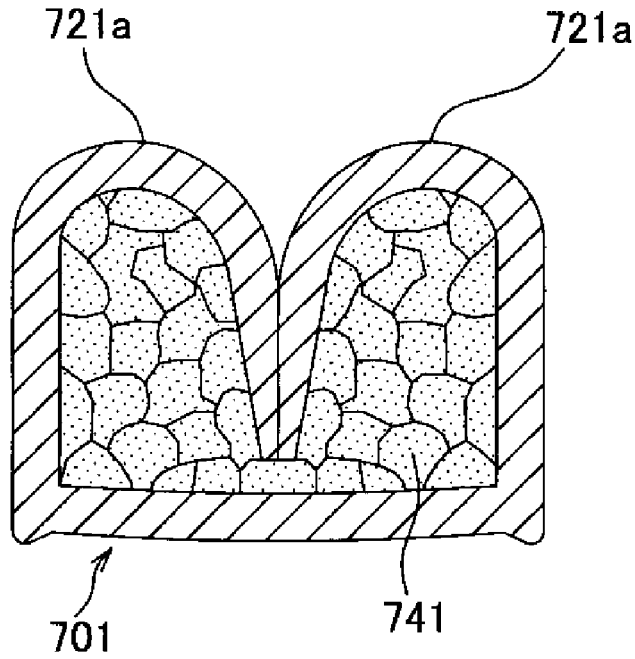
FIG. 9 is a cross-sectional view taken along the line IV-IV of FIG. 8.
Figure 10:
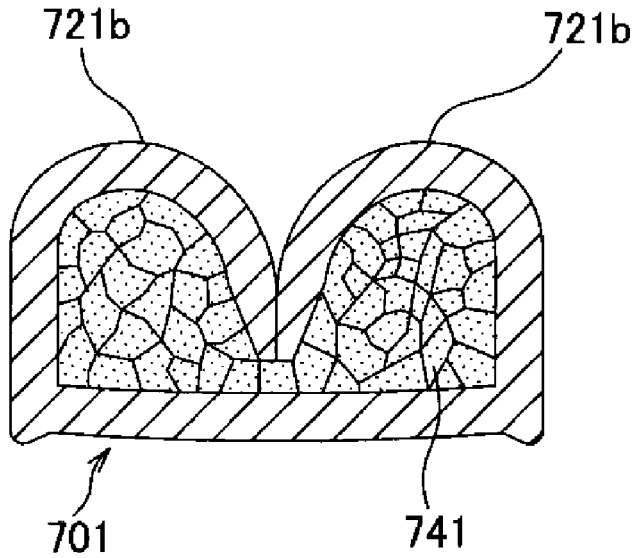
FIG. 10 is a cross-sectional view taken along the line V-V of FIG. 8.

Next, a method of attaching the terminal fitting 3 having the above-described configuration to the aluminum core wire 41 will be described. First, as shown in FIG. 7, the terminal fitting 3 is disposed on the surface 19*a* of the anvil 19 so that the groove 27*a* of the crimper 27 faces the pair of core wire crimping pieces 35 while the anvil 19 and the crimper 27 are away from each other.

Then, the aluminum core wire 41 of the cable 4 is positioned on the bottom wall 34 located between the pair of core wire crimping pieces 35 of the terminal fitting 3. Accordingly, the aluminum core wire 41 is disposed and overlapped on the upper side of the bottom wall 34 which is a part of the wire connection portion 32 of the terminal fitting 3.

Subsequently, the rod 29 of the air cylinder 17 is extended. Then, the crimper 27 moves closer to the anvil 19, so that the pair of core wire crimping pieces 35 is deformed along the inner surface of the groove 27*a* provided in the crimper 27. That is, each of the pair of core wire crimping pieces 35 is bent inward so that the front ends 35*a* face the bottom wall 34. Then, the terminal fitting 3 is attached to the cable 4 while the terminal fitting 3 and the aluminum core wire 41 of the cable 4 are interposed between the anvil 19 and the crimper 27. Finally, the pair of core wire crimping pieces 35 is bent so that the outer surfaces 35 are tightly overlapped with each other, and the pair of intermeshing portions 38 mesh with each other to fix the pair of core wire crimping pieces 35 to each other. Then, as shown in FIG. 5, the aluminum core wire 41 is press-bonded to the terminal fitting 3 while the bottom wall 34 and the pair of core wire crimping pieces 35 are brought into tightly contact with each other.

Then, the rod 29 of the air cylinder 17 is contracted so that the anvil 19 and the crimper 27 move away from each other, thereby removing the terminal fitting 3 on the anvil 19.

As described above, according to the invention, the pair of core wire crimping pieces 35 is bent so that the outer surfaces 35*b* are tightly overlapped with each other, and has the pair of intermeshing portions 38 respectively formed at the outer surfaces 35*b* in the length direction of the wire connection portion 32, that is, the length direction of the aluminum core wire 41 overlapped with the bottom wall 34, where the pair of intermeshing portions has a plurality of grooves 39 and is adapted to mesh with each other. The deformation caused by the bending of the pair of core wire crimping pieces 35 cancels the restoring force, and the pair of intermeshing portions 38 meshes with each other, whereby the pair of core wire crimping pieces 35 is fixed to each other, and the tightly fitted state of the aluminum core wire 41 using the pair of core wire crimping pieces 35 may be maintained. For this reason, the aluminum core wire 41 may be reliably press-bonded by preventing a springback. Further, since an excessive press-bonding operation (for example, a compression ratio of a conductor (core wire) becomes 70% or less) may not be performed by preventing the springback, the fixation strength of the aluminum core wire 41 may be ensured.

Further, the plurality of grooves 39 provided in the pair of intermeshing portions 38 are formed in a wedge shape which is cut into the thickness direction of the pair of core wire crimping pieces 35, and the width W3 of the pair of wall portions 39*a* forming the grooves 39 is equal to the opening width W1 of the grooves 39, that is, the cross-sectional shape of the grooves 39 of the pair of intermeshing portions 38 is formed as an equilateral triangle. Accordingly, the intermeshing portion may be made to easily mesh with each other so that they are reliably fixed to each other. Further, since the shape of the groove 29 is simple, the groove may be easily provided.

Further, since the opening width W1 of the grooves 39 of the pair of intermeshing portions 38 is 1/20 of the thickness of the pair of core wire crimping pieces 35, the pair of core wire crimping pieces 35 may be fixed to each other without degrading the strength of the pair of core wire crimping pieces 35.

Furthermore, the above-described embodiment is merely an exemplary embodiment of the invention, and the invention is not limited to the embodiment. That is, various modifications may be performed within the scope not departing from the concept of the invention.

In the above-described embodiment, since the intermeshing portion 38 has the plurality of grooves 39, the tightly fitted state of the aluminum core wire 41 may be maintained by using the pair of core wire crimping pieces 35. For example, as a modified example, the meshing operation may be performed by forming the intermeshing portion 38 as a jaggy portion. Further, as another modified example, the meshing operation may be performed by forming one of the intermeshing portions 38 as a concave portion and forming the other of the intermeshing portions as a convex portion. Moreover, as another modified example, the meshing operation may be performed by forming the intermeshing portion 38 as a claw. Furthermore, as another modified example, the meshing operation may be reinforced by providing a conductive adhesive in the intermeshing portion 38. In addition, the intermeshing portion 38 may be processed to have a high friction force. The invention is not limited to these modified examples, and various modified examples may be adopted.

Priority is claimed on Japanese Patent Application No. 2008-225596, filed Sep. 3, 2008, the content of which is incorporated herein by reference.

INDUSTRIAL APPLICABILITY

According to the invention, when the wire harness core wire made of aluminum or aluminum alloy, which is becoming widely used in recent years, is crimped by the terminal fitting made of copper or copper alloy, the aluminum core wire may be reliably press-bonded by preventing a contact error or the like caused by a difference in the springback characteristic. Further, since an excessive press-bonding operation may not be performed by preventing the springback, the fixation strength of the aluminum core wire may be ensured.

REFERENCE SIGNS LIST

1 PRESS-BONDING DEVICE
3 TERMINAL FITTING
4 WIRE
31 ELECTRIC CONTACT PORTION
32 WIRE CONNECTION PORTION
34 BOTTOM WALL
35 PAIR OF CORE WIRE CRIMPING PIECES (PAIR OF CRIMPING PIECES)
36 PAIR OF COATING PORTION CRIMPING PIECES
38 PAIR OF INTERMESHING PORTIONS
39 GROOVE
39*a* PAIR OF WALL PORTIONS
41 ALUMINUM CORE WIRE (CORE WIRE)
42 COATING PORTION
W1 OPENING WIDTH OF GROOVE
W3 WALL PORTION WIDTH OF GROOVE

The invention claimed is:

1. A terminal fitting that crimps a wire made of aluminum or aluminum alloy, the terminal fitting comprising:

a bottom wall on which the wire is disposed and which has two end portions opposite each other; and a pair of crimping pieces each of which has an outer surface with an intermeshing portion and which is formed upright from the corresponding end portion, the crimping pieces being bent to crimp the wire so that one intermeshing portion meshes with the other intermeshing portion, wherein each intermeshing portion has a plurality of grooves, and wherein the plurality of grooves of the pair of intermeshing portions are formed in a wedge shape cut into the thickness direction of the pair of crimping pieces, and the width of a pair of wall portions forming the grooves is equal to the opening width of the groove.

2. The terminal fitting according to claim 1, wherein each intermeshing portion has a surface with a jaggy portion.

3. The terminal fitting according to claim 1, wherein one of the intermeshing portions has a concave portion, and the other intermeshing portion has a convex portion.

4. The terminal fitting according to claim 1, wherein each intermeshing portion has a conductive adhesive.

5. The terminal fitting according to claim 1, wherein each intermeshing portion has a high friction force.

6. The terminal fitting according to claim 1, wherein the intermeshing portions are brought into close contact with each other when the crimping pieces are bent.

7. The terminal fitting according to claim 1, wherein the opening width of the grooves is formed to be equal to or more than 1/20 and equal to or less than 1/10 of the thickness of the pair of crimping pieces.

* * * * *